US009846978B1

(12) United States Patent
Tseng et al.

(10) Patent No.: US 9,846,978 B1
(45) Date of Patent: Dec. 19, 2017

(54) REMAINING USEFUL LIFE ESTIMATION OF VEHICLE COMPONENT

(71) Applicant: Ford Global Technologies, LLC, Dearborn, MI (US)

(72) Inventors: Fling Finn Tseng, Ann Arbor, MI (US); Dimitar Petrov Filev, Novi, MI (US); Imad Hassan Makki, Dearborn Heights, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 0 days.

(21) Appl. No.: 15/182,865

(22) Filed: Jun. 15, 2016

(51) Int. Cl.

| | |
|---|---|
| ***G07C 5/00*** | (2006.01) |
| ***G07C 5/08*** | (2006.01) |
| ***G07C 5/12*** | (2006.01) |

(52) U.S. Cl.
CPC ..... *G07C 5/0808* (2013.01); *G07C 5/006* (2013.01); *G07C 5/008* (2013.01); *G07C 5/12* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,609,051 | B2 | 8/2003 | Fiechter et al. | |
| 6,859,831 | B1 * | 2/2005 | Gelvin | B60R 25/1004 340/539.19 |
| 8,600,831 | B2 | 12/2013 | Xiao et al. | |
| 8,849,497 | B2 | 9/2014 | Zhang et al. | |
| 9,002,775 | B1 | 4/2015 | Harrison et al. | |
| 9,056,556 | B1 * | 6/2015 | Hyde | B60L 11/1851 |
| 2011/0238259 | A1 | 9/2011 | Bai et al. | |
| 2011/0264318 | A1 * | 10/2011 | Laforge | G07C 5/008 701/22 |
| 2015/0239365 | A1 * | 8/2015 | Hyde | B60L 11/1861 701/2 |
| 2015/0379786 | A1 * | 12/2015 | LaForge | G07C 5/008 701/22 |

FOREIGN PATENT DOCUMENTS

EP 2884465 A1 12/2014

* cited by examiner

*Primary Examiner* — Yonel Beaulieu
(74) *Attorney, Agent, or Firm* — Frank A. MacKenzie; Bejin Bieneman PLC

(57) ABSTRACT

A vehicle system includes a processor and a memory accessible to the processor and storing computer-executable instructions. The instructions include receiving data from a plurality of vehicles, generating at least one cluster from the received data, and determining a life cycle profile for a vehicle component based on the at least one cluster. The data includes state of health information associated with the vehicle component.

11 Claims, 4 Drawing Sheets

REMAINING USEFUL LIFE ESTIMATION OF VEHICLE COMPONENT

BACKGROUND

Automobiles include many components, some of which require regular maintenance. Automotive tires, brake pads, engine oil, etc., need to be periodically replaced. Sometimes, sensors can be used to measure wear on particular components and alert the vehicle operator when a particular component is due for maintenance.

DETAILED DESCRIPTION

Figure 1:
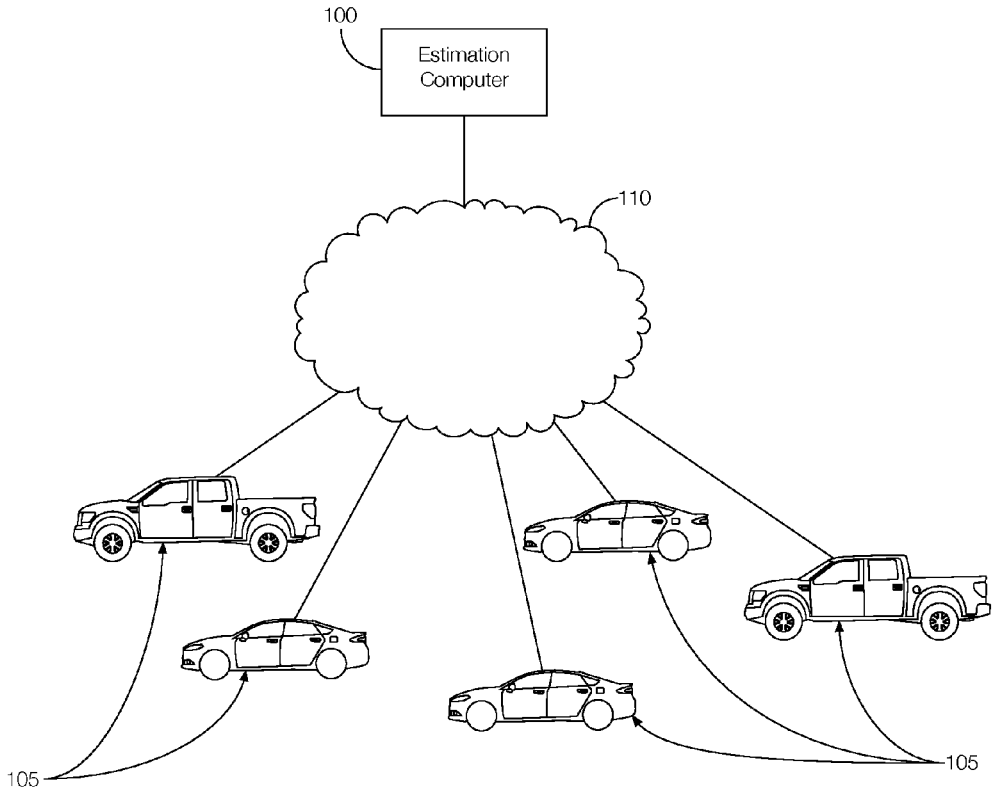
FIG. 1 illustrates an example estimation computer that aggregates vehicle component data from multiple vehicles.

Vehicle prognostics, in general, is difficult because state of health information is difficult to assess for many vehicle components. That is, providing sensors for all vehicle components that wear over time can be cost-prohibitive. Some information may not be directly observable or accessible even if a sensor could be used. Moreover, even with the appropriate sensor data, models for certain component degradation do not currently exist.

One solution includes an online evolving clustering method implemented by a prognostic system that tracks the wear of particular vehicle components and notifies vehicle owners when those components may need maintenance. The prognostic system may receive data about a particular vehicle component from multiple vehicles, generate one or more clusters from the received data, and determine a life cycle profile for the vehicle component based on the cluster. The data received from the vehicles includes state of health information associated with the vehicle component. The life cycle profile may estimate the state of health of the particular component based on, e.g., the age of the component, the way the component is used, the conditions under which the component is used, or any combination thereof. The prognostic system may notify the vehicle owner when a particular vehicle component needs maintenance based on the estimated life cycle given the data in the cluster. Alternatively or in addition, the prognostics information may be displayed at a level easily understandable to the vehicle owner while a more detailed, technical explanation is stored onboard and made available to technicians or maintenance personnel. The prognostic system may update the clusters with additional data as it is received. Updating the clusters could include creating new clusters, combining clusters, eliminating clusters, or the like.

By way of example, the prognostic system may receive data on how a particular brand of brake pads wear over time. From that data, the prognostic system may develop various phases, including a wearing phase, a stable phase, and a near end of life phase. Only three phases are discussed for purposes of simplicity. The prognostic system may develop any number of phases including, e.g., additional phases to better fit the non-linearity exhibited by a single degradation profile. In general, more phases may result in more precise prognostics. The wearing phase may refer to when the brake pads are relatively new. The stable phase may be the longest phase and may begin after the brake pads have been "broken in" and may end before the brake pads have deteriorated. The near end of life phase may refer to the period of time immediately before the brake pads deteriorate to a point where they should be replaced relatively soon. The phases may be a function of time, how often or aggressively the vehicle component is used, or both. When the prognostic system predicts that the brake pads in a particular vehicle have reached the near end of life phase, the prognostic system may output a notification to the owner to that vehicle.

The data may be received from many vehicles over time. For example, each time a vehicle with a particular brand of brakes is brought into a service center, the technician may note the age of the brakes, the state of the brakes (e.g., percentage of the pad remaining), how the vehicle is used (e.g., mostly highway, mostly surface streets, long trips, short trips, etc.), as well as any other information that contributes to developing a life cycle model for that particular brand of brakes. Similar data may be captured to model wear on other vehicle components including tire wear, oil degradation, etc. Further, the prognostic system may generate clusters based on various combinations of data (e.g., a particular brand of brakes and a particular brand of motor oil).

With the prognostic system, the technician and vehicle owner may have better access to the overall vehicle health. The data may be further used for inventory management (i.e., service centers can stock appropriate replacement parts based on the life cycle models so vehicle owners do not need to wait for parts to ship), better vehicle design that accounts for and tries to minimize degradation, and so on.

The elements shown may take many different forms and include multiple and/or alternate components and facilities. The example components illustrated are not intended to be limiting. Indeed, additional or alternative components and/or implementations may be used. Further, the elements shown are not necessarily drawn to scale unless explicitly stated as such.

As illustrated in FIG. 1, the prognostic system includes an estimation computer 100 in communication with multiple target vehicles 105 over a communication network 110. The estimation computer 100 is programmed to aggregate component data, such as state of health information, from multiple target vehicles 105. It processes the component data to estimate the remaining useful life for one or more vehicle components. For example, the estimation computer 100 may be programmed to create clusters from the component data, determine a life cycle profile for the component based on the cluster, and predict wear on the component from the life cycle profile. The life cycle profile may include various phases, including a wearing phase, a stable phase, and a near end of life phase. When a particular component installed in a real vehicle is estimated to be at or near the near end of life phase, the estimation computer 100 transmits a message to the vehicle owner recommending that the component be evaluated or replaced. The actual state of health of the component may be confirmed by a service technician, as described in greater detail below.

The three phases previously discussed are for purposes of simplicity. The life cycle profile may include additional phases to, e.g., provide more precision with respect to the prognostics. Further, different life cycle profiles may apply to the same components. For instance, different life cycle profiles may be used to account for varying combinations of effects certain impact factors may have on the overall shape on the life cycle profile. By way of example, given otherwise similar conditions, a driver that typically brakes lightly and gradually may wear out the brakes much more slowly than a driver that accelerates and brakes more aggressively and more frequently. Thus, two life cycle profiles may be developed to capture the effect of these different braking patterns, and specifically, how these different braking patterns affect the brake wear.

The target vehicles 105 transmitting data to the estimation computer 100 may include any passenger or commercial automobile such as a car, a truck, a sport utility vehicle, a crossover vehicle, a van, a minivan, a taxi, a bus, etc. In some possible approaches, the vehicle is an autonomous vehicle configured to operate in an autonomous (e.g., driverless) mode, a partially autonomous mode, and/or a non-autonomous mode. Examples of non-automotive target vehicles 105 that may provide component data to the estimation computer 100 include trains, airplanes, boats, etc.

In one possible approach, at least some of the component data may be transmitted to the estimation computer 100 from a computer or smartphone. In other words, the component data may not be transmitted to the estimation computer 100 directly from the target vehicle 105. One example scenario includes when a target vehicle 105 is taken to a service station. A service technician may note the amount of wear on a particular vehicle component and transmit component data to the estimation computer 100 using a smartphone, laptop, tablet, or desktop computer.

Moreover, when a target vehicle 105 is brought in for service following, e.g., a message from the estimation computer 100, the service technician may confirm the life cycle phase of the component at issue. That is, if the message was received by the owner of the target vehicle 105 because a particular component was predicted to be at the near end of life phase, the service technician may visually inspect the component to determine whether the estimation computer 100 accurate predicted the life cycle phase.

The communication network 110 may include various electronic components to facilitate wired or wireless communication between the estimation computer 100, the target vehicles 105, computers, smartphones, or the like. The communication network 110 may facilitate communication over any number of wired or wireless communication protocols. Examples of such protocols may include LTE, 3G, WiFi, Ethernet, etc.

Figure 2:
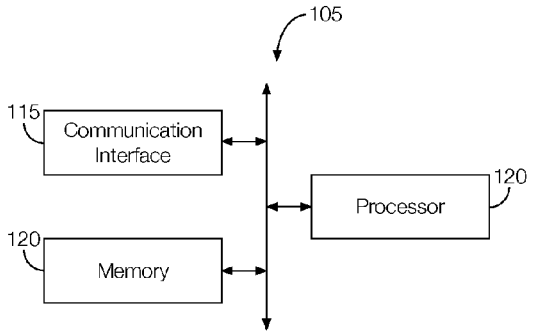
FIG. 2 is a block diagram of example components of the estimation computer of FIG. 1.

FIG. 2 illustrates example components of the estimation computer 100. As shown, the estimation computer 100 includes a communication interface 115, a memory 120, and a processor 125.

The communication interface 115 includes circuits and other electronic components that facilitate communication over the communication network 110. The communication interface 115, therefore, may receive signals representing component data transmitted from various target vehicles 105. The communication interface 115 may transmit the component data to the processor 125, the memory 120, or both.

The memory 120 includes circuits and other electronic components that allow data storage. The memory 120, therefore, may be programmed to receive and store component data. In one possible approach, the component data may be stored in a database that relates the component data in various clusters. Further, the memory 120 may store the life cycle profile for each component, a list (database) of target vehicles 105 with the particular component installed, owner contact information for each target vehicle 105, etc. The memory 120 may also be programmed to store computer-executable instructions and make such instructions available to the processor 125.

The processor 125 includes circuits and other electronic components that can access and execute the instructions stored in the memory 120. The processor 125 may be programmed to receive the component data, generate clusters from the component data, and determine a life cycle profile for the vehicle component associated with the component data. The processor 125 may receive the component data directly from the communication interface 115 or from one or more databases stored in the memory 120.

The processor 125 may be further programmed to identify various product phases based on the life cycle profile. The product phases may include a wearing phase, a stable phase, and a near end of life phase, and each phase may be associated with a particular amount of time. The wearing phase may be a relatively short phase that occurs immediately after the component has been installed in a target vehicle 105. The wearing phase may be better understood as a "breaking in" phase. The stable phase may follow the wearing phase. The stable phase may be the longest among the phases and may represent most of the useful life of the component. The near end of life phase may follow the stable phase. That is, the near end of life phase may define the period of time at the tail end of the component's useful life. Thus, a component in or approaching the near end of life phase may need to be replaced relatively soon.

Since some vehicle components can be used in different ways, the processor 125 may further develop the life cycle profile based on how a particular component is used. For instance, a component used often or more aggressively may reach the near end of life phase faster than a component used seldom or less aggressively. The processor 125 may cluster component data according to usage, develop different life cycle profiles for each cluster, and relate the appropriate life cycle profile to the appropriate target vehicle 105 based on component usage in the database.

By way of example, the processor 125 may develop different clusters, and thus different life cycle profiles, for different uses of a particular brand of brake pads. That is, component data concerning aggressively used brake pads may be incorporated into one cluster that is used to generate one life cycle profile while component data concerning less aggressively used brake pads may be incorporated into a different cluster used to generate a different life cycle profile. Moreover, component data for a target vehicle 105 that is driven daily may show faster brake wear than component data for a target vehicle 105 that is only driven once or twice a week. Thus, that difference in usage may form the basis for two distinct clusters. Likewise, component data for brake pads on a target vehicle 105 that is mostly highway driven may show slower wear than component data for brake pads on a target vehicle 105 that is mostly driven in urban areas. Those different types of usages, therefore, may serve as the basis for distinct clusters.

The processor 125 may use the life cycle profile for a particular component to notify the owner of a target vehicle 105 with the particular component installed that the component is at the near end of life phase. For instance, the processor 125 may be programmed to determine, from the database stored in the memory 120, that a target vehicle 105 has the particular component installed, the amount of time the component has been in use, and the amount of remaining useful life according to the life cycle profile for the component. When the remaining useful life indicates that the component is in or approaching the near end of life phase, the processor 125 may be programmed to retrieve the contact information for the owner of the target vehicle 105 and command the communication interface 115 to transmit a notification to the owner of the target vehicle 105 indicating that the component should be evaluated or replaced.

In one possible approach, the processor 125 may set various thresholds associated with the state of health of the component that can be used to determine where a particular component falls on the life cycle profile. For example, the processor 125 may define a low or high threshold for a measurable or otherwise observable indicator that strongly correlates to state of health. Whether the threshold is low or high may depend on the circumstances or the component. For instance, an example of a low threshold may be where brake pad thickness is measured. A thinner brake pad suggests more wear, so a "low" threshold may be more appropriate than a "high" threshold. An example of a high threshold may include monitoring for braking energy consumed per unit distance since a higher value may suggest that the brakes are closer to the near end of life phase.

Different thresholds may apply to each phase of the life cycle profile. The processor 125 may compare the value to the various thresholds to determine where the component falls on the life cycle profile. The notification to the vehicle owner may be generated and sent when the most recent estimation indicates that the component is at or approaching the near end of life phase.

The processor 125 may be programmed to periodically update the clusters with updated component data received. Updating the clusters may include creating a new cluster, adding the updated component data to an existing cluster, separating an existing cluster into two clusters, combining the component data from multiple clusters into a single cluster, eliminating a previously existing cluster and redistributing the component data from the eliminated cluster into new or different clusters, etc. The updated component data may be received by the processor 125 in response to signals associated with one or more target vehicles 105 being transmitted to the estimation computer 100 over the communication network 110.

Figure 3:
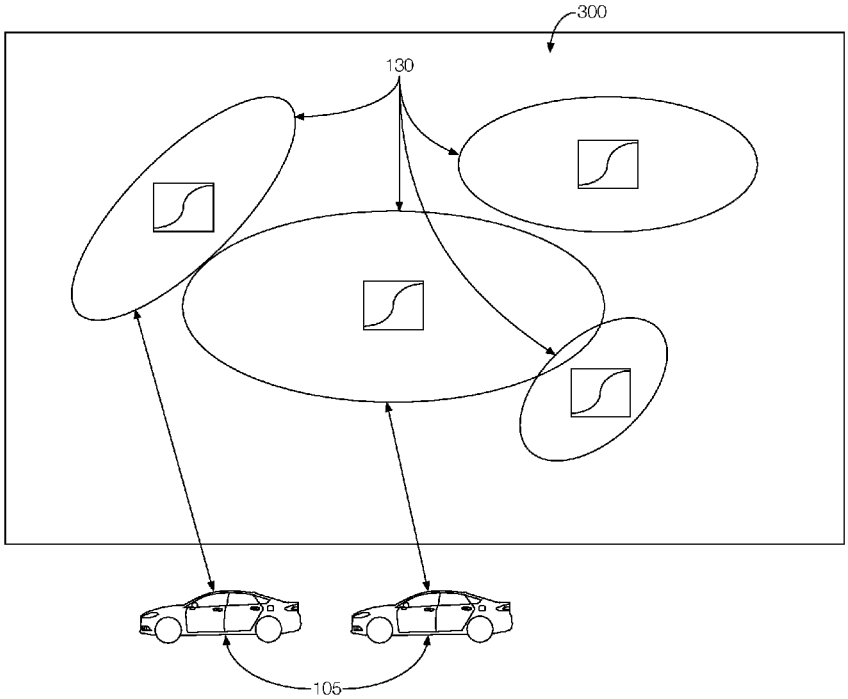
FIG. 3 is a graphical representation of clusters that may be formed from the vehicle component data and associated to particular vehicles.

FIG. 3 is a graphical representation 300 of clusters 130 that may be formed from the vehicle component data and associated to particular vehicles. The clusters 130 may be formed in accordance with any cluster analysis technique such as the Mahalanobis distance technique or a squared distance (such as a Euclidean distance) technique. In general, each cluster 130 represents major groups of data in a data stream. Each cluster 130 is characterized by a mean and a covariance metric. The center (mean) and orientation of the data are considered in generating each cluster 130. Data is incorporated into the clusters 130 on a sample by sample basis. That is, new data is used to update the clusters 130 without having to process historical data each time. As a result, clusters 130 can move, be created, be combined, be removed, etc., over time. For instance, new data collected may indicate a new pattern that ultimately is used to form a new cluster 130.

Data provided by particular vehicles may be grouped into one or more clusters 130. The clusters may be updated in accordance with the rate at which signals describing the usage of a component are received. Further, the remaining useful life model of each cluster may be updated in accordance with the availability of the state of health information. As a result, the clusters and life cycle profile may be updated at the same time, at different times, at the same rate, or at different rates. For instance, state of health information may be received less often than other types of information associated with developing the clusters. Moreover, as the remaining useful life information is generated, the remaining useful life information may be transmitted to the owners of the target vehicles 105. For example, as discussed above, the remaining useful life information may be transmitted when the remaining useful life information for a particular target vehicle 105 is at or approaching the near end of life phase.

Figure 4:
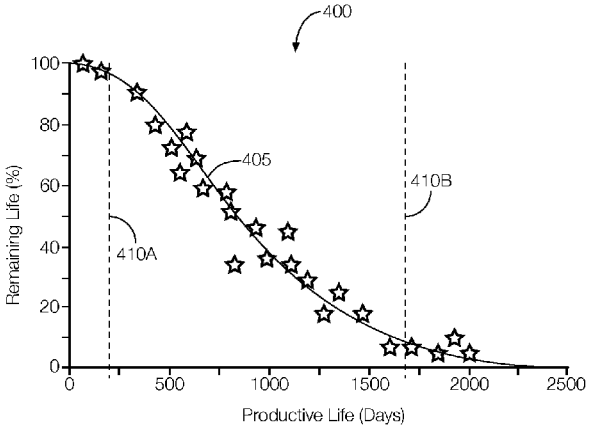
FIG. 4 is a graph illustrating a component life cycle generated from various data collected from multiple vehicles.

FIG. 4 is a graph 400 illustrating a component life cycle generated from data collected from multiple vehicles over time and incorporated into a cluster. The X-axis represents time in days and the Y-axis represents the remaining life as a percentage. The solid line 405 may be a function of the collected data (shown as stars). For instance, the line 405 may be generated, at least in part, from a cumulative distribution function and shaped at least partially via a least squares method. The different phases are separated by vertical lines 410A and 410B. The line 410A may separate the wearing phase 135 from the stable phase 140, and the line 410B may separate the stable phase 140 from the near end of life phase 145.

As shown, the wearing phase 135 ends, and the stable phase 140 begins, when the remaining life is approximately 95%. The stable phase 140 ends, and the near end of life phase 145 begins, when the remaining life is approximately 10%. These numbers are merely examples for purposes of simplicity. Different percentages may be applied based on the type of component, the expected rate of degradation, etc.

Figure 5:
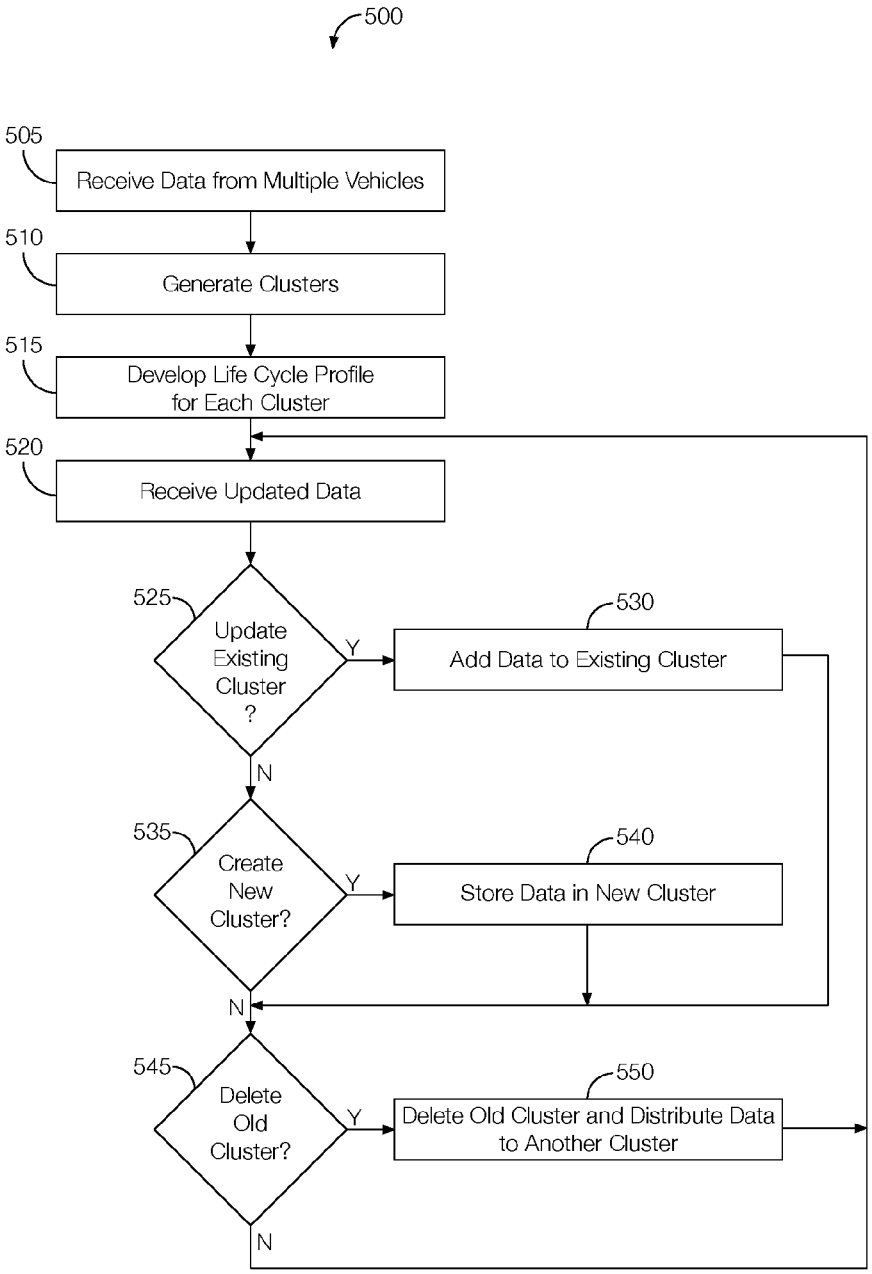
FIG. 5 is a flowchart of an example process that may be executed by the estimation computer to aggregate the component data.

FIG. 5 is a flowchart of an example process 500 that may be executed by the estimation computer 100 to aggregate the component data. The process 500 may be executed by the estimation computer 100 periodically so that new data may be continually sampled. Computer-executable instructions for the process 500 may be stored in the memory 120 and made accessible to components of the estimation computer 100, such as the processor 125.

At block 505, the estimation computer 100 receives component data. The component data can be received from multiple vehicles over a period of time. The component data may be received via the communication interface 115 and stored in the memory 120 where it can be accessed by the processor 125.

At block 510, the estimation computer 100 generates clusters. The clusters can be generated by, e.g., the processor 125 according to various statistical techniques including a Mahalanobis distance technique. The processor 125 may cluster the component data according to the type of component, the make of the component, the model of the component, the way the component is used, whether the component is part of a group of at least one other component, or the like.

At block 515, the estimation computer 100 develops the life cycle profile for each cluster. The life cycle profile may estimate the state of health of the particular component based on, e.g., the age of the component, the way the component is used, or both. The processor 125 may develop the life cycle profile by, e.g., identifying various product phases based on the life cycle profile. As discussed above, the product phases may include a wearing phase, a stable phase, and a near end of life phase, and each phase may be associated with a particular amount of time. The wearing phase may be a relatively short phase that occurs immediately after the component has been installed in a target vehicle 105. The wearing phase may be better understood as a "breaking in" phase. The stable phase may follow the wearing phase. The stable phase may be the longest among the phases and may represent most of the useful life of the component. The near end of life phase may follow the stable phase. That is, the near end of life phase may define the period of time at the tail end of the component's useful life. Thus, a component in or approaching the near end of life phase may need to be replaced relatively soon.

At block 520, the estimation computer 100 may receive updated component data. The updated component data may be received via the communication interface 115 and stored in the memory 120. The processor 125 may access the updated component data from the memory 120 for processing, including the processing that occurs at block 525, 535, and 545.

At decision block 525, the estimation computer 100 determines whether to update an existing cluster with the component data received at block 520. For instance, the processor 125 may use, e.g., the Mahalanobis distance technique to determine whether the component data received at block 520 should be applied to an existing cluster. The processor 125 may make such a decision if the component data received at block 520 is based on the same type of component, use of the component, etc., as the previously received component data in an existing cluster. If an existing cluster is to be updated, the process 500 proceeds to block 530. If not, the process 500 proceeds to block 535.

At block 530, the estimation computer 100 adds the component data received at block 520 to an existing cluster. Adding the component data may include the processor 125 applying various statistical techniques, discussed above, to the updated component data and updating the life cycle profile for the cluster, if necessary, based on the updated component data. The process 500 may proceed to block 545.

At decision block 535, the estimation computer 100 determines whether to create a new cluster with the component data received at block 520. For instance, the processor 125 may use, e.g., the Mahalanobis distance technique to determine whether the component data received at block 520 is different enough from the previously received component data in the existing clusters that it should be incorporated into a new cluster, either alone or with previously received component data.

For instance, if the component data received at block 520 is from a different type of component, a different type of use, etc., the processor 125 may determine that the component data received at block 520 should be incorporated into a new cluster. In this instance, the process 500 proceeds to block 540. If not (e.g., the processor 125 determines that no new cluster is needed), the process 500 proceeds to block 545.

At block 540, the estimation computer 100 creates a new cluster with the updated component data. Creating the new cluster may include moving previously received component data from an already existing cluster into a new cluster. Moreover, the new cluster may be formed to include component data that previously appeared to be an outlier relative to the previously existing clusters. Thus, creating a new cluster may include reducing the size of a previously existing cluster. Further, creating the new cluster may include the processor 125 applying various statistical techniques, discussed above, to the updated component data and generating the life cycle profile for the cluster based on the updated component data as well as any other component data incorporated into the new cluster. The process 500 may proceed to block 545.

At decision block 545, the estimation computer 100 determines whether to delete an existing cluster or merge one existing cluster with another. For instance, the processor 125 may determine that an existing cluster should be deleted if the updated component data renders one or more previously existing clusters meaningless. For instance, if the component data received at block 520 serves as a link between the component data in two clusters, the clusters may be combined (i.e., merged), effectively deleting one of the clusters. Or, if the updated component data shows that the data in one cluster is actually outlier data relative to another cluster, the cluster with the outlier data may be deleted and the outlier data redistributed or excluded from all clusters. To determine if two clusters should be merged, the processor 125 may identify two clusters with overlapping coverage and evaluate distance between the centroids of both clusters involved. If the overlap is significant and the distance between the centroids is statistically significant, the processor 125 may decide to merge the clusters. If the overlap is insignificant or if the distance between the centroids is insignificant, the processor 125 may decide to keep the clusters separate. If the processor 125 determines that a cluster should be deleted, the process 500 proceeds to block 550. Otherwise, the process 500 proceeds to block 520 so that additional component data can be received and considered.

At block 550, the estimation computer 100 deletes the old cluster selected at block 545 (or merges two or more clusters, as the case may be). To delete the old cluster, the processor 125 may redistribute all component data previously incorporated into the deleted cluster or treat certain component data from the deleted cluster as outlier data, which may be ignored. The processor 125 may distribute the component data in the deleted cluster to an existing cluster as discussed above with regard to block 530, create a new cluster with the component data from the deleted as discussed above with respect to block 540, or a combination of both. To merge a cluster, the processor 125 may combine the data from the merging clusters and define the merged cluster in a way that maintains the centroids and original coverage of the original clusters. Further, the processor 125 may redevelop the life cycle profile for each cluster that was updated or created as a result of deleting one of the clusters or merging two clusters. The process 500 may proceed to block 520 so that additional component data may be considered, and the clusters and life cycle profiles updated.

Figure 6:
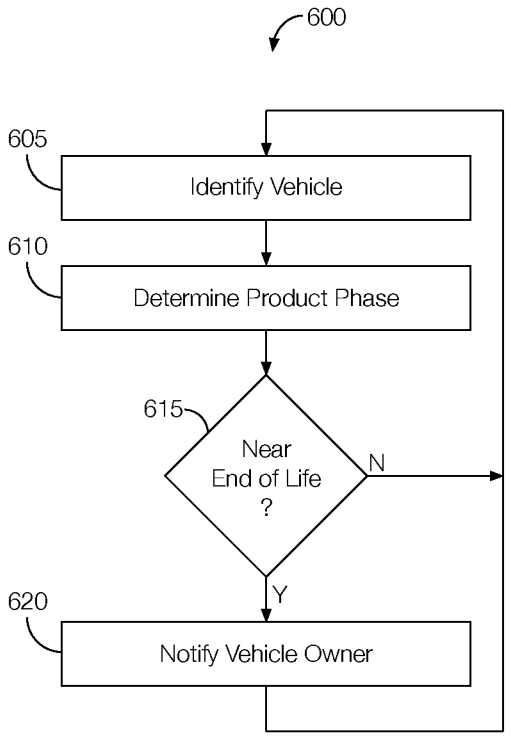
FIG. 6 is a flowchart of an example process that may be executed by the estimation computer to notify vehicle owners of significant times associated with the life cycle of a particular vehicle component.

FIG. 6 is a flowchart of an example process 600 that may be executed by the estimation computer 100 to notify vehicle owners of significant times associated with the life cycle of a particular vehicle component. The process 600 may be executed periodically (on the order of every few hours, every few days, every few weeks, etc.) for each target vehicle 105. Computer-executable instructions for the process 600 may be stored in the memory 120 and made accessible to components of the estimation computer 100, such as the processor 125.

At block 605, the estimation computer 100 identifies a target vehicle 105. The target vehicle 105 may be identified by the processor 125 according to a database stored in the memory 120. The target vehicle 105 may be one that has contributed component data to the prognostic system, has a particular component installed, uses a particular component in a particular way, or the like.

At block 610, the estimation computer 100 determines the product phase associated with one or more components of the target vehicle 105. For instance, the processor 125 may identify one or more relevant clusters, identify one or more components associated with the identified clusters, and determine how long the one or more components have been installed in the target vehicle 105 identified at block 605. The processor 125 may compare the amount of time the component has been installed to the life cycle profiles associated with the identified clusters. If multiple clusters are involved, the processor 125 may determine the product phase according to a weighted average (based on similarity) of the life cycle profiles associated with each of the individual identified clusters. Thus, the life cycle profile that most closely resembles the actual wear on the component may be given more weight by the processor 125 when determining the product phase. The processor 125 may determine whether the component is in the wearing phase, the stable phase, the near end of life phase, or any other phase defined in the life cycle profile. If in the stable phase, the processor 125 may further determine how much time before the component is likely to reach the near end of life phase.

At decision block 615, the estimation computer 100 determines whether the component is at or quickly approaching the near end of life phase. The processor 125 may determine whether the component is at or approaching the near end of life phase based on the life cycle profile, the amount of time remaining until the component is estimated to reach the near end of life phase, or the like. If the component is already at the near end of life phase, or if the component is estimated to reach the near end of life phase before the process 600 is subsequently executed, the process 600 may proceed to block 620. If the component is not at the near end of life phase, the process 600 may return to block 605.

At block 620, the estimation computer 100 may transmit a notification to the owner of the target vehicle 105. The notification may indicate that the subject component should be evaluated or replaced. The processor 125 may generate the notification and command the communication interface 115 to transmit the notification to the owner of the target vehicle 105. The notification may be transmitted via any wireless communication protocol. Moreover, the notification may be transmitted via, e.g., email, text message, an in-vehicle alert, or the like.

In general, the computing systems and/or devices described may employ any of a number of computer operating systems, including, but by no means limited to, versions and/or varieties of the Ford Sync® application, AppLink/Smart Device Link middleware, the Microsoft Automotive® operating system, the Microsoft Windows® operating system, the Unix operating system (e.g., the Solaris® operating system distributed by Oracle Corporation of Redwood Shores, Calif.), the AIX UNIX operating system distributed by International Business Machines of Armonk, N.Y., the Linux operating system, the Mac OSX and iOS operating systems distributed by Apple Inc. of Cupertino, Calif., the BlackBerry OS distributed by Blackberry, Ltd. of Waterloo, Canada, and the Android operating system developed by Google, Inc. and the Open Handset Alliance, or the QNX® CAR Platform for Infotainment offered by QNX Software Systems. Examples of computing devices include, without limitation, an on-board vehicle computer, a computer workstation, a server, a desktop, notebook, laptop, or handheld computer, or some other computing system and/or device.

Computing devices generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, Java™, C, C++, Visual Basic, Java Script, Perl, etc. Some of these applications may be compiled and executed on a virtual machine, such as the Java Virtual Machine, the Dalvik virtual machine, or the like. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

A computer-readable medium (also referred to as a processor-readable medium) includes any non-transitory (e.g., tangible) medium that participates in providing data (e.g., instructions) that may be read by a computer (e.g., by a processor of a computer). Such a medium may take many forms, including, but not limited to, non-volatile media and volatile media. Non-volatile media may include, for example, optical or magnetic disks and other persistent memory. Volatile media may include, for example, dynamic random access memory (DRAM), which typically constitutes a main memory. Such instructions may be transmitted by one or more transmission media, including coaxial cables, copper wire and fiber optics, including the wires that comprise a system bus coupled to a processor of a computer. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

Databases, data repositories or other data stores described herein may include various kinds of mechanisms for storing, accessing, and retrieving various kinds of data, including a hierarchical database, a set of files in a file system, an application database in a proprietary format, a relational database management system (RDBMS), etc. Each such data store is generally included within a computing device employing a computer operating system such as one of those mentioned above, and are accessed via a network in any one or more of a variety of manners. A file system may be accessible from a computer operating system, and may include files stored in various formats. An RDBMS generally employs the Structured Query Language (SQL) in addition to a language for creating, storing, editing, and executing stored procedures, such as the PL/SQL language mentioned above.

In some examples, system elements may be implemented as computer-readable instructions (e.g., software) on one or more computing devices (e.g., servers, personal computers, etc.), stored on computer readable media associated therewith (e.g., disks, memories, etc.). A computer program product may comprise such instructions stored on computer readable media for carrying out the functions described herein.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc. should be read to recite one or more of the indicated elements unless a claim recites an explicit limitation to the contrary.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

The invention claimed is:

1. A vehicle system comprising a processor and a memory accessible to the processor and storing computer-executable instructions, the instructions including:

receiving data from a plurality of vehicles, the data including state of health information associated with a vehicle component;

generating a first cluster from the received data;

determining a life cycle profile for the vehicle component based on the first cluster;

periodically updating the first cluster with updated data; and creating a second cluster after generating the first cluster, and wherein periodically updating the first cluster includes transferring data from the first cluster to the second cluster.

2. The vehicle system of claim 1, the instructions including determining a product phase of the vehicle component based on the life cycle profile.

3. The vehicle system of claim 2, the instructions including transmitting a notification to a target vehicle when the product phase of the vehicle component is a near end of life phase.

4. The vehicle system of claim 2, wherein the product phase includes a wearing phase, a stable phase, and a near end of life phase.

5. The vehicle system of claim 2, wherein the product phase is based at least in part on usage of the vehicle component.

6. The vehicle system of claim 1, wherein periodically updating the first cluster includes updating the first cluster with data previously included in a third cluster, and the instructions further including deleting the third cluster after updating the first cluster with the data previously included in the third cluster.

7. A method comprising:

receiving data from a plurality of vehicles, the data including state of health information associated with a vehicle component;

generating a first cluster from the received data;

determining a life cycle profile for the vehicle component based on the first cluster;

periodically updating the first cluster with updated data; and creating a second cluster after generating the first cluster, and wherein periodically updating the first cluster includes transferring data from the first cluster to the second cluster.

8. The method of claim 7, further comprising determining a product phase of the vehicle component based on the life cycle profile.

9. The method of claim 8, further comprising transmitting a notification to a target vehicle when the product phase of the vehicle component is a near end of life phase.

10. The method of claim 8, wherein the product phase is based at least in part on usage of the vehicle component.

11. The method of claim 7, wherein periodically updating the at least one cluster includes updating the first cluster includes updating the first cluster with data previously included in a third cluster, and the method further comprising deleting the third cluster after updating the first cluster with the data previously included in the third cluster.

* * * * *